US005540076A

United States Patent [19]

Baensch et al.

[11] Patent Number: 5,540,076

[45] Date of Patent: Jul. 30, 1996

[54] CRANK MECHANISM FOR A COLD PILGER ROLLING MILL

[75] Inventors: Michael Baensch, Mönchengladbach; Ralf Bonsels, Hückelhoven, both of Germany

[73] Assignee: Mannesmann Aktiengesellschaft, Dusseldorf, Germany

[21] Appl. No.: 326,524

[22] Filed: Oct. 20, 1994

[30] Foreign Application Priority Data

Oct. 20, 1993 [DE] Germany ..... 43 36 422.5

[51] Int. Cl.[6] ..... B21B 35/00

[52] U.S. Cl. ..... 72/214; 72/249

[58] Field of Search ..... 72/208, 214, 249

[56] References Cited

U.S. PATENT DOCUMENTS 3,584,489 6/1971 Peytavin ..... 72/208

4,386,512 6/1983 Rehag et al. ..... 72/214

*Primary Examiner*—Lowell A. Larson

*Assistant Examiner*—Thomas C. Schoeffler

*Attorney, Agent, or Firm*—Cohen, Pontani, Lieberman, Pavane

[57] ABSTRACT

A cold pilger rolling mill which has a roll stand that can be moved back and forth, a pair of cranks each having a crankpin, a pair of thrust rods that connect the roll stand to the crankpins, and centrifugal counterweights connected to the cranks so as to be eccentric to the rotational axis of the crank to at least partially balance inertial mass. The centrifugal weights are staggered by 180 degrees to the connection point of the respective thrust rod and crank and each crank and its associated counterweights forms a submechanism. The submechanisms are arranged in a mirror image around a vertical plane which intersects a roll axis. A common drive is provided for driving the roll stand. The drive includes a drive shaft that connects the submechanisms to one another and is located beneath a rolling plane. The submechanisms have rotational axes that run horizontally parallel to one another, and the drive turns the cranks in opposite directions.

6 Claims, 3 Drawing Sheets

CRANK MECHANISM FOR A COLD PILGER ROLLING MILL

BACKGROUND OF THE INVENTION

1. Field of the Invention

The invention relates to a cold pilger rolling mill with a roll stand that can be moved back and forth, which is connected via two thrust rods to the crankpins of two cranks, and the inertial forces of which can be at least partially balanced by counterweights in the form of centrifugal weights attached to the cranks eccentric to the rotational axis of the cranks and staggered by 180 degrees to the linkage point of the thrust rods.

2. Description of the Prior Art

In conventional cold pilger rolling mills, tile back and forth movement of the roll stand is produced by crank mechanisms of various types. During rolling, the large moving inertial masses of the rolling mill produce very great inertial forces, which necessitate countermeasures in order to reduce vibrations. In the simplest models, the countermeasures are limited to the attachment of counterweights to the crank of the crank mechanism. However, such measures achieve only a poor balance of mass and are not suitable for preventing the vibrations.

Most cold pilger rolling mills are equipped with a torque and mass compensation system which permits the complete compensation of mass forces of the first order as well as very good torque compensation. A known cold pilger rolling mill accomplishes this by means of a torque compensation system, connected to the crank mechanism, which stores the kinetic energy that is released during the deceleration of the roll stand to a dead center position in a counterweight that is attached to the crank mechanism staggered by 90 degrees and can be vertically moved up and down, and then re-uses this energy during the subsequent acceleration of the rolling mill. This vertical torque compensation system, incorporating the roll torque on the forestroke and the backstroke, frees the entire drive between the drive motor and the crankshaft from temporarily back-flowing kinetic energy. In other words, at a constant crank speed, the drive moment is also constant to a great extent, because the kinetic energy flows back and forth between the subgears without placing a load on the motor ("Machines and Equipment for the Production of Tubes using the Cold Pilger Process," in *Mannesmann Demag Hüttentechnik*, pp. 18 and 19). Although this known design addresses the requirements for adequate mass and torque compensation, it has the disadvantage of requiring deep foundations which represent a considerable share of investment costs. Another disadvantage is that expensive split beatings must be used on the crank throws and as the middle crankshaft bearing.

For small-sized tubes, the use of planetary crank mechanisms, which also allow complete mass compensation and complete torque compensation, has been suggested. Non-split bearings can be used with these rolling mills and deep foundations are not required; however, this design cannot be carried over to cold pilger rolling mills for large-sized tubes.

Finally, DE 41 24 691 C1 suggests simplifying the crank mechanism of a cold pilger rolling mill by constructing this mechanism of three parallel and equidistant shafts, with the middle shaft being designed as the crankshaft and linked via its crankpin to the thrust rod connectable to the roll stand. A main weight is attached eccentric to the crank in staggered fashion, and located on the two other shafts are auxiliary weights, which together are to balance the inertial mass of the roll stand. This drive configuration does indeed allow complete mass force compensation of the first order with the use of non-split bearings; however, it also requires relatively deep foundations, because the entire mechanism, including the drive pins, balancing weights, bearings, gearwheels and housing, must be located underneath the fixed center of the roll in order to permit the rolled tube to emerge freely. When the minimum heights for these components are added to the total height of the mechanism, deep excavations in the foundation again become necessary, particularly in the case of cold pilger rolling mills for large-sized tubes. Furthermore, the known suggestion does not provide for any countermeasures against the non-uniformity of the crank angle speed.

SUMMARY OF THE INVENTION

Starting from a cold pilger rolling mill of the type described in DE 41 24 691 C1, the object of the present invention is to provide a crank drive for a generic rolling mill which achieves optimal mass and torque compensation while being of simple design and which can function with non-split bearings and shallow foundations and is therefore economical.

Pursuant to this object, and others which will become apparent hereafter, one aspect of invention resides in dividing the mechanism consisting of the crank drive and the counterweights into two submechanisms located in mirror-image fashion around a plane which vertically intersects the roll path. The submechanisms are connected to one another via the shaft of a common drive train, which consists of a motor, a coupling and a bevel gear transmission and is located beneath the rolling plane. The rotational axes of the submechanisms are horizontal and parallel to each other and the cranks of the two submechanisms turn in opposite directions.

A crank drive is thus provided which consists of two submechanisms, one located to the left and one to the right of the roll path, whereby the rotational axes of the submechanism shafts are horizontal and, except for the driveshaft, are preferably located on a common plane. The division into two submechanisms allows the free passage of the rolled tube, even if it is of a larger size, whereby the drives are to be located below or above the rolling plane. Because of this, only shallow foundations are necessary.

The suggested crank drive configuration permits the use of non-staggered thrust cranks as the roll stand drive, which has not been possible in previous drives, e.g., those of the MEER type, because the tube produced in the cold pilger process has had to be borne away across the crankshaft.

In one embodiment of the invention, tile drive of the cold pilger rolling mill has a drive motor located beneath the rolling plane with a driveshaft parallel to the roll path. The driveshaft is connected via a coupling to a distributing gear, whose driveshaft halves, which run perpendicular to the roll path on both sides and horizontally, transmit the drive moment to the submechanisms. In this way, the produced tube simply needs to be borne away across the lower drive, while one half of the crank mechanism is located on each side of tile tube.

In another embodiment of the invention, in order to balance the remaining inertial forces, additional centrifugal weights are attached to shafts parallel to the rotational axes of each submechanism crank. These shafts mesh via spur gears with spur gears on the crank mechanism so that the centrifugal weights of the cranks and the additional centrifugal weights turn in opposite directions.

The centrifugal weights on the submechanism cranks balance tile centrifugal forces of the rotating mass of the crank mechanism and the thrust rod. An additional share of centrifugal weight on each crank, as well as centrifugal weights equal to this share on intermediate shafts which turn at the speed of the cranks in an opposite direction, permit complete compensation of the first order oscillating inertial forces of the roll stand and thrust rod.

In order to balance the oscillating inertial forces of the second order, another embodiment of the invention calls for vertically rotating balance weights to be eccentrically attached to the two driveshafts, on both sides of the vertical plane. These driveshafts are driven at double the crank speed and in opposite directions of rotation.

According to still another embodiment of the invention, the additional centrifugal weights of each submechanism are distributed, respectively, on two pairs of parallel shafts, which are attached in synchronized fashion via spur gears to both sides of the divided crank mechanism.

In summary, the crank mechanism according to the invention attains the sought after objective through the following effects aimed at compensating for mass actions:

(1) The centrifugal weights on the cranks initially balance the centrifugal forces of the rotating mass of the crank drive and the thrust rod.

(2) An additional share of centrifugal weight on each crank, as well as centrifugal weights equal to this share on intermediate shafts turning at the speed of the crank in the opposite direction, permits the complete compensation of first order oscillating inertial forces of the roll stand and the thrust rod. The centrifugal weights on the intermediate shafts can also be distributed on two shafts.

(3) The special configuration of the submechanisms prevents the creation of mass force moments by the centrifugal weights because the mass force moments remaining in the crank mechanism parts balance each other.

(4) The movement of the cranks in opposite directions insures that the inertial moments of the thrust rods will balance each other.

(5) Balance weights attached eccentrically to the shaft which connects the drive train to the submechanisms balance oscillating inertial forces of the second order. In addition, a balance weight can be provided on the driveshaft to flatten the speed curve of the crankshaft and thus of the crank mechanism.

The crank mechanism according to the present invention is distinguished by the complete compensation of mass forces of the first and second orders, by the complete compensation of all mass force moments of the first order, and by the complete compensation of the mass moments of the thrust rods. The inventive configuration functions with shallow foundations and does not require expensive split bearings. Variants of the drive kinematics are conceivable, and three of these are depicted in the drawings and described below.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
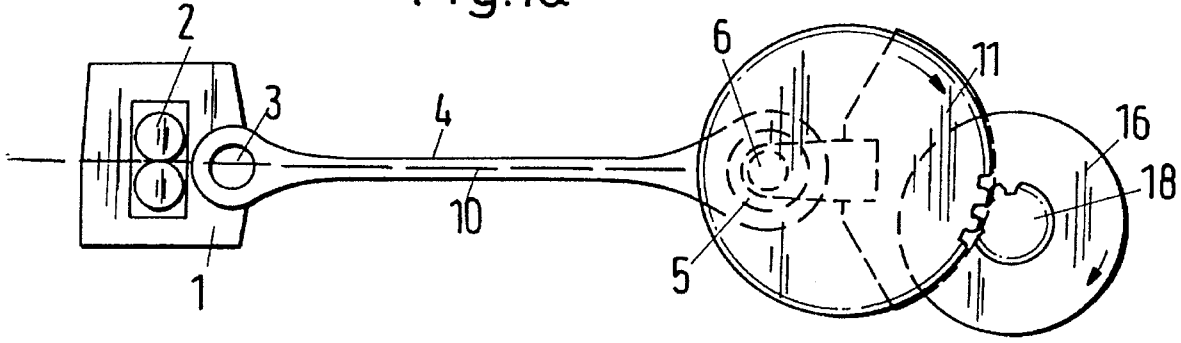
FIGS. 1*a* and 1*b* are elevation and top views of a simplest form of the crank mechanism according to the invention.
Figure 1B:
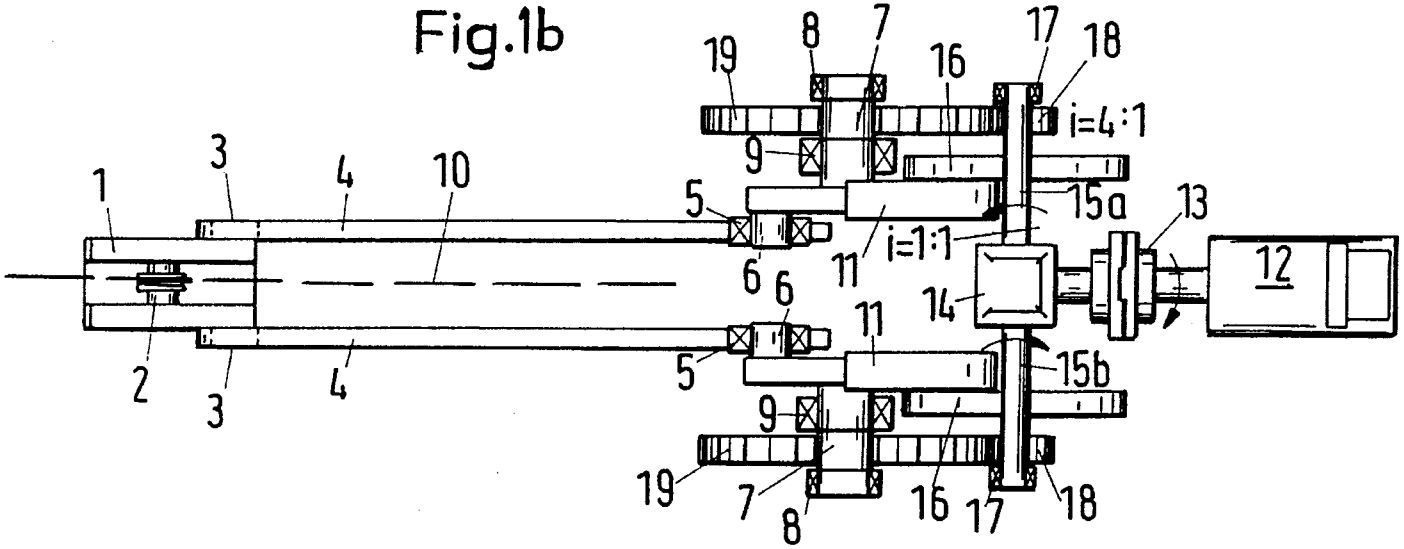

In FIG. 1*a*, reference number 1 indicates the roll stand which moves back and forth, in which the cold pilger roller pair 2 is located. On both sides of the roll stand 1, a thrust rod 4 is linked at a position 3 in rotatable fashion. An opposite end of the thrust rod 4 is located at a position 5 on respective crankpins 6 of cranks 7, which in turn are located at bearings 8 and 9 on a housing, which is not shown. As shown in FIG. 1*b*, two mirror-image submechanisms, which contain the cranks 7 as well as the other drive elements, are located on both sides of an imaginary plane which passes vertically through the roll path 10. A centrifugal weight 11 sits eccentrically on each crank 7 of each submechanism and is staggered by 180 degrees to the crankpin 6. The combined weight of the two centrifugal weights 11 of the two submechanisms is great enough so that all rotating and oscillating inertial forces of the first order are balanced.

It can be seen that the configuration of the submechanisms on both sides of the roll path 10 permits the free discharge of the rolled tube inbetween the two thrust rods 4 and across the drive train. As shown in FIG. 1*b*, the drive train consists of a motor 12, a coupling 13 and a bevel gear transmission 14, which distributes the drive moment to a crankshaft composed of two shaft halves 15*a* and 15*b*, which are aligned with one another and which run perpendicular to the drive train and horizontally. Each of the shaft halves 15*a*, 15*b* carries a balance weight in the form of a balance wheel 16 in order to flatten the speed curve of the crankshaft. The shaft halves 15*a* and 15*b* are mounted at bearing 17 and carry one spur gear 18 each. The spur gear 18 meshes in the illustrated example with a spur gear 19 (transmission ratio =4:1) on the crank 7 and sets the crank into rotation. The balance wheels 16 and the centrifugal weights 11 run at synchronized speeds in the direction of the illustrated arrows and thus make the compensation possible.

Figure 2A:
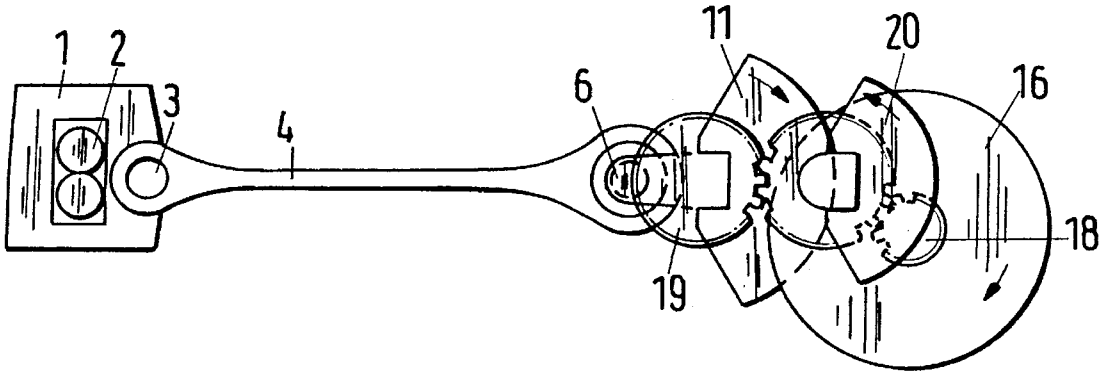
FIGS. 2*a* and 2*b* are views similar to FIGS. 1*a* and 1*b* of the crank mechanism according to the invention with complete compensation.
Figure 2B:
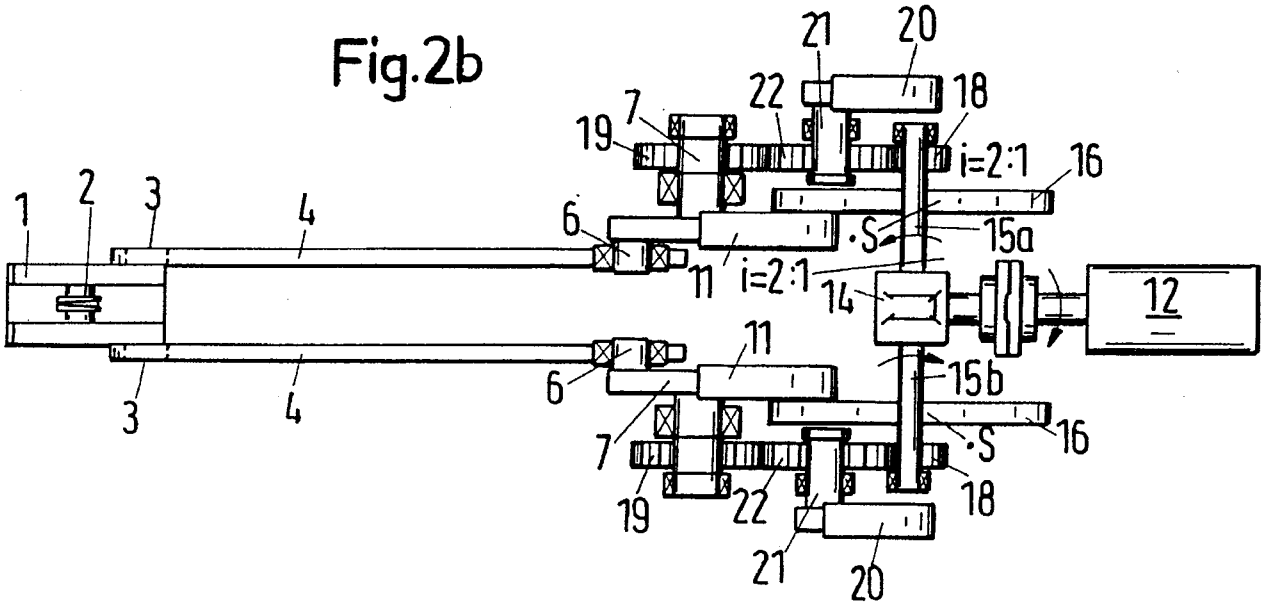

The crank mechanism configuration shown in FIGS. 2*a* and 2*b* permits an even better compensation by means of additional centrifugal weights 20 which, together with the centrifugal weights 11 on the two cranks 7, balance the centrifugal forces of the rotating masses of the crank 7 and thrust rod 4 as well as the first order oscillating inertial force of the roll stand 1 and thrust rod 4. The additional centrifugal weights 20 are attached to shafts 21, which run parallel to the rotational axis of the cranks 7 on the same horizontal plane and which carry one spur gear 22 each. The spur gears 22 mesh, first of all, with the spur gears 18 of the driveshaft halves 15*a* and 15*b* and, secondly, with the spur gears 19 on the cranks 7, and transmit the drive torque with a corresponding transmission. In this example, the balance wheels 16 on the driveshaft halves 15*a* and 15*b* are eccentrically attached so that they balance oscillating inertial forces of the second order at a speed which is double the crank mechanism speed. Components of the same type as in FIGS. 1*a* and 1*b* are shown the same in FIGS. 2*a* and 2*b*.

Figure 3A:
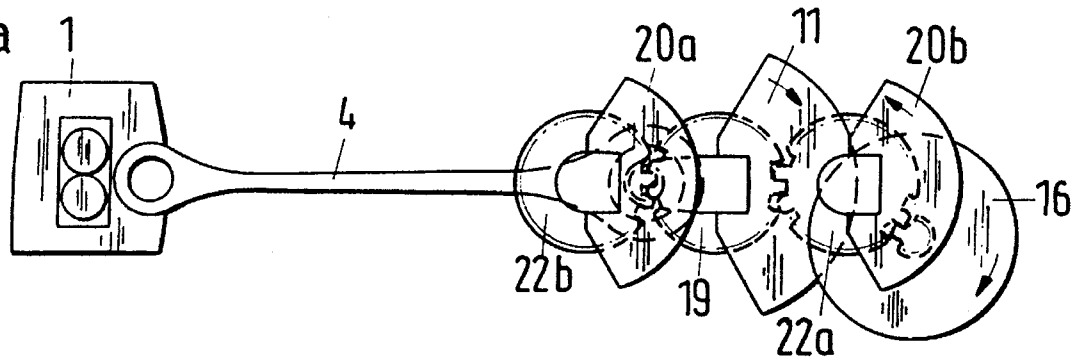
FIGS. 3*a* and 3*b* are views similar to FIGS. 1*a* and 1*b* of a crank mechanism according to the invention, in which the additional centrifugal weights are divided.
Figure 3B:
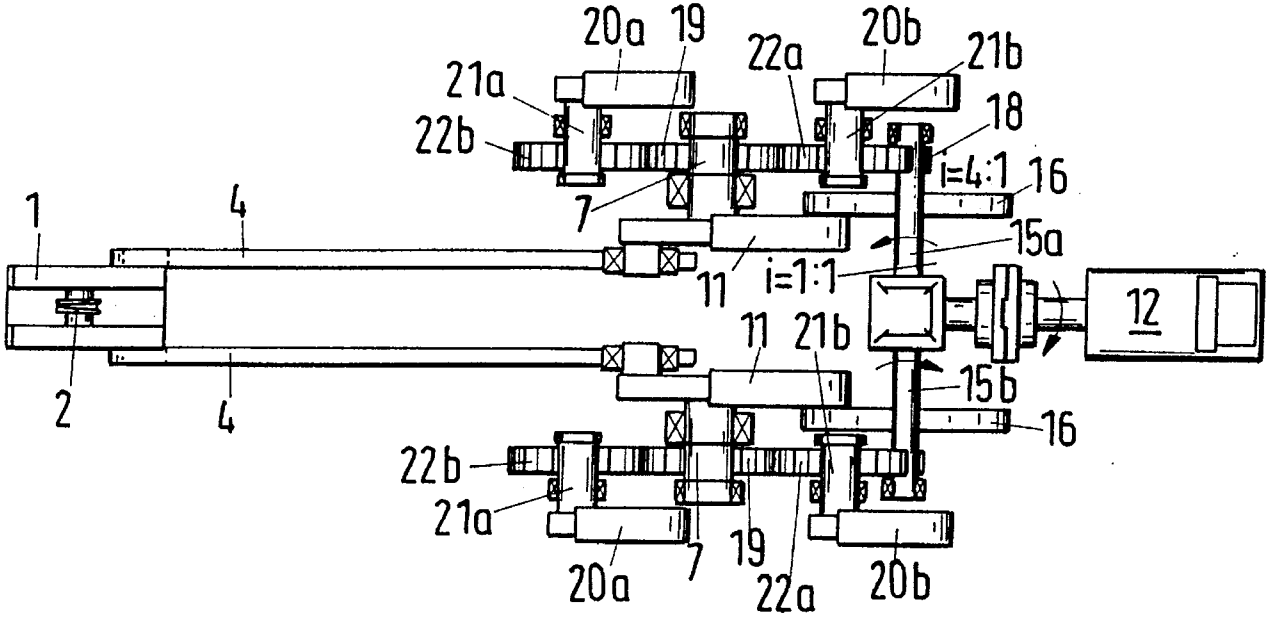

FIGS. 3*a* and 3*b* show a mechanism which, even when the two cranks 7 turn in the same direction, permits complete compensation of the mass forces and mass force moments of the first order, although no balance of the mass moments of the thrust rods then occurs. In the configuration of the crank drive according to the invention shown here, additional centrifugal weights 20*a* and 20*b* are divided on the two shafts 21 a and 21*b*, which are located on either side of and parallel to the rotational axis of the cranks 7. The two centrifugal weights 20*a* and 20*b* turn in the direction opposite to that in which the crank 7 turns, whereby the drive moment is distributed via the spur gears 18, 22*a*, 19 and 22*b*. Components which are common to the other figures are shown with the same reference numerals.

The invention is not limited by the embodiments described above which are presented as examples only but can be modified in various ways within the scope of protection defined by the appended patent claims.

We claim:

1. A cold pilger rolling mill, comprising: a roll stand that can be moved back and forth; a pair of cranks each rotatable about an axis and having a crank pin; a pair of thrust rods that connect the roll stand to the crank pins; centrifugal counterweights connected to the cranks so as to be eccentric to the rotational axes of the cranks to at least partially balance inertial mass, the centrifugal counterweights being staggered by 180 degrees to the crank pins, each crank and its associated counterweights forming a submechanism, the submechanisms being arranged in a mirror image around a vertical plane which intersects a roll path; and common drive means for driving the roll stand, said drive means arranged symmetrically to the roll path and including a submechanism drive shaft that connects together and directly drives each of the submechanisms, the drive means being located beneath a rolling plane, the submechanisms having rotational axes that run parallel to one another and horizontally, the drive means turning the cranks in opposite directions.

2. A cold pilger rolling mill as defined in claim 1, wherein the drive means includes a motor, a motor drive shaft parallel to the roll path, a distributor gear, and a coupling that connects the motor drive shaft to the distributor gear, the submechanism drive shaft being split into halves which run perpendicular to the roll path horizontally on opposite sides of the distributor gear to transmit drive moment to the submechanisms from the distributor gear.

3. A cold pilger rolling mill as defined in claim 2, and further comprising vertically rotatable balance weights attached eccentrically to the submechanism drive shaft which connects the distributor gear to the submechanisms on opposite sides of the vertical plane so as to balance second order oscillating inertial forces.

4. A cold pilger rolling mill as defined in claim 2, wherein the distributor gear is a bevel gear transmission.

5. A cold pilger rolling mill as defined in claim 1, and further comprising spur gears on the cranks, additional shafts arranged parallel to the rotational axes of the cranks of the submechanisms and additional centrifugal weights attached to the additional shafts in order to balance remaining inertial forces, spur gears being provided on the additional shafts to connect the shafts in a meshing fashion to the spur gears on the cranks so that the centrifugal counterweights of the cranks and the additional centrifugal weights turn in opposite directions.

6. A cold pilger rolling mill as defined in claim 5, and further comprising two further additional shafts, two additional shafts being parallel to each crank, the additional centrifugal weights of each submechanism are distributed, respectively, on the parallel shafts, still further comprising spur gears for synchronously attaching the parallel shafts to opposite sides of the cranks of each submechanism.

* * * * *